United States Patent [19]

Peskin

[11] 4,268,121

[45] May 19, 1981

[54] FULL VIEW DUAL-USE MIRROR APPARATUS

[76] Inventor: Samuel Peskin, 18700 Walkers Choice Rd., Gaithersburg, Md. 20760

[21] Appl. No.: 144,582

[22] Filed: Apr. 28, 1980

[51] Int. Cl.[3] ..... G02B 7/18

[52] U.S. Cl. ..... 350/306; 248/472; 248/480

[58] Field of Search ..... 350/305, 306, 299; 248/472, 480, 486

[56] References Cited

U.S. PATENT DOCUMENTS 574,254 12/1896 Mosher et al. ..... 350/305

2,119,208 5/1938 Goldsmith ..... 350/306

FOREIGN PATENT DOCUMENTS 213364 4/1924 United Kingdom ..... 350/306

*Primary Examiner*—Jon W. Henry

*Attorney, Agent, or Firm*—McCaleb, Lucas & Brugman

[57] ABSTRACT

Dual-use mirror apparatus comprising a pair of upright rectangular frames with reflecting mirror surfaces on the front sides. The mirror frames are pivotally connected at their top and bottom edges to the ends of telescopic rods. A free-standing model has both frames supported on caster wheels. The apparatus may be unfolded to an open position in which the frames are spaced apart a distance permitted by extension of the rods. In this open position, the reflecting mirror surfaces diverge forwardly and outwardly to provide side and partial rear views of a user. Alternatively, the apparatus may be folded into a compact, closed position, one frame lying over the other with the front frame facing forwardly for use as a single, direct-viewing, front-on single mirror. A modified form shows one mirror frame supported on a vertical member such as a door or wall and the other mirror frame supported on caster wheels for movement between open and closed positions.

10 Claims, 11 Drawing Figures

Fig. 1.
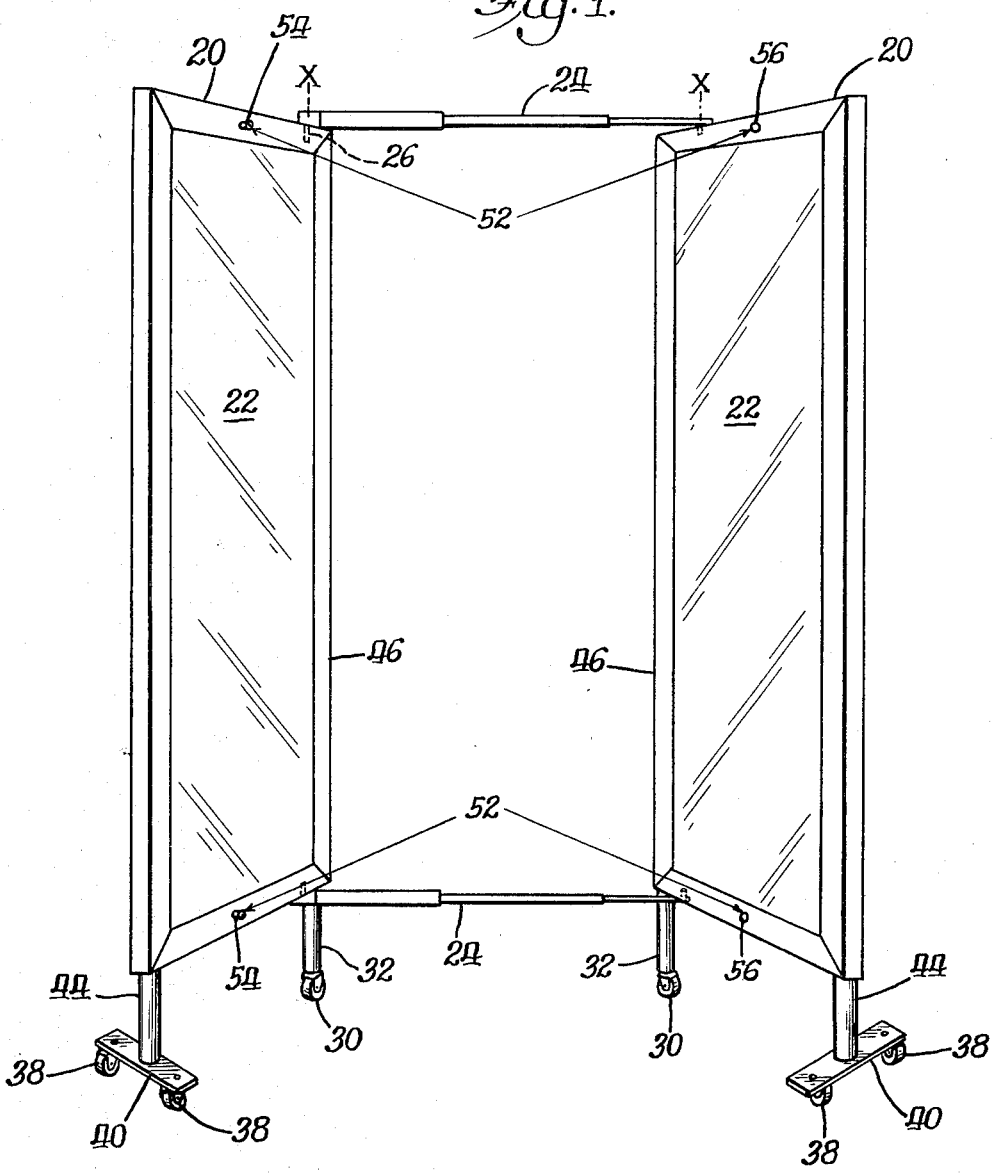
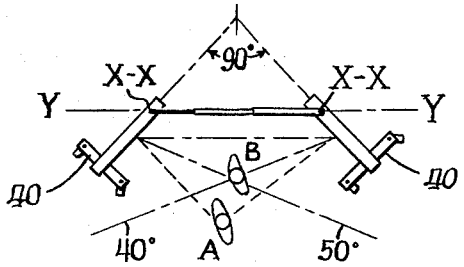
Fig. 2.

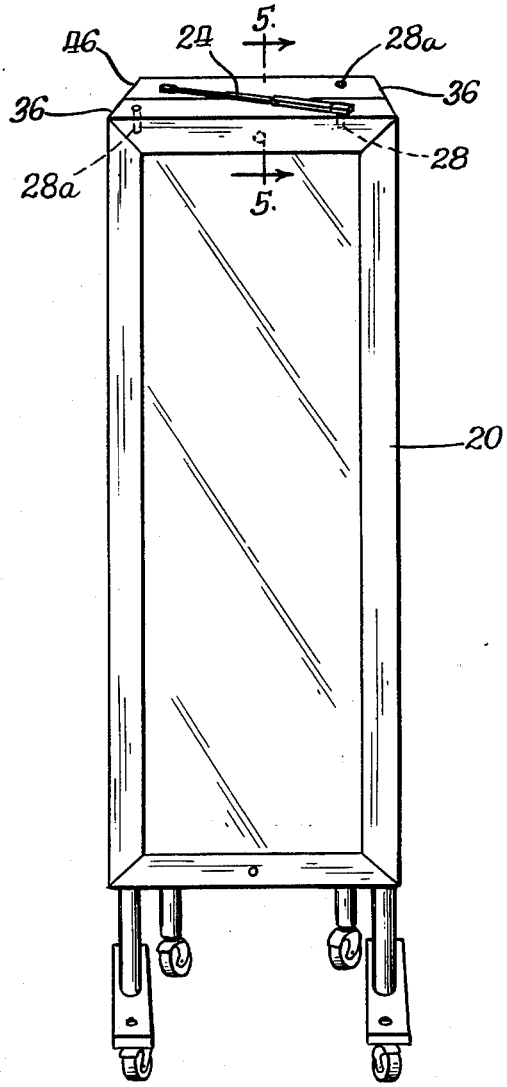
Fig. 3.
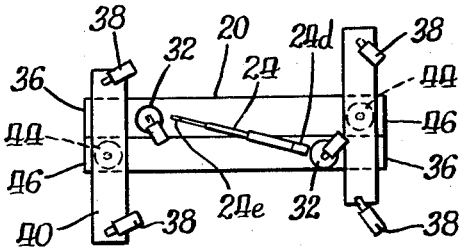
Fig. 4.
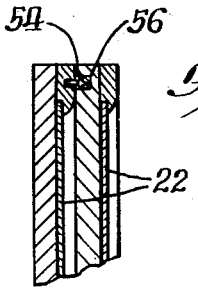
Fig. 5.
Fig. 11.
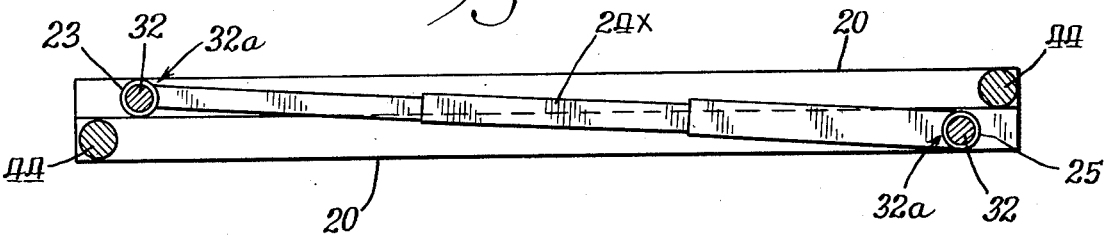

46
20
22
20
32
44
32
24
44
36
38
40
34
46
42
38
32
44
30
30
40
38
38
X
X
24e
24c
26
24b
X
24a
24d
26
X

FULL VIEW DUAL-USE MIRROR APPARATUS

BACKGROUND OF THE INVENTION

The field of the present invention is mirrors.

A standard mirror arrangement commonly found for example in clothing fitting rooms comprises three vertical mirrors. These consist of a central mirror providing a direct, face-on view, and a pair of angularly-oriented wing or side mirrors diverging forwardly and outwardly from the central mirror toward the viewer and providing side and partial rear views of the user.

Although these standard three-mirror arrangements are quite effective, they are in the nature of a permanent installation with space requirements comparable to that of a small or medium sized closet. There are applications such as dressing rooms for homes, hotels, and other places, where such dual-use mirror arrangements would be advantageous but the space is not permanently available. For such applications, attempts have been made to provide three-section folding mirrors in which the side mirrors can be folded back in the same plane as the center mirror, and the entire apparatus stored against a wall when not in use. These have not been entirely satisfactory because they are heavy, bulky in both open and closed positions, and often unattractive and cumbersome even when folded flat out of use.

SUMMARY OF THE INVENTION

It is a general object of the present invention to provide a two-mirror arrangement which has substantially all the front, side and rear viewing capabilities of the above-described conventional three-mirror arrangement.

Another object is to provide such a two-mirror arrangement which is foldable and readily convertible, on the one hand, to an open position in which the two mirrors are spaced apart and forwardly and outwardly divergent, to duplicate the function of the side mirrors in the conventional three-mirror arrangement, and, on the other hand, readily convertible to a compact, closed position where one mirror overlies the other to duplicate the front on direct viewing function of the center mirror in such conventional three-mirror arrangement.

Another object is to provide such an improved two-mirror arrangement in which the two mirrors are pivotally connected to the ends of telescopic rods which are limitedly extendable to determine the spacing between the mirrors when used in the open position.

Another object is to provide a free-standing version in which both mirrors are supported on wheels or casters.

Another object is to provide a semi-free-standing version of the invention in which one of the mirrors is mounted on a vertical member such as a door or wall and the other mirror is supported on wheels or casters for movement between open and closed positions.

Other objects and advantages will be apparent from the following description taken in connection with the accompanying drawings in which:

BRIEF DESCRIPTION OF THE DRAWINGS

FIG. 1 is a front view of a free standing version of the present invention;

FIG. 2 is a top view of FIG. 1;

FIG. 3 is a closed view of the apparatus with one of the mirrors facing forward in position for front on, direct viewing;

FIG. 4 is a bottom view of FIG. 3;

FIG. 5 is a fragmentary vertical sectional view of FIG. 3 taken on line 5—5;

FIG. 11 is a bottom view of a pair of mirror frames similar to those in FIG. 7, with a modified attachment for the telescopic rod.

Like parts are referred to by like reference characters.

DETAILS DESCRIPTION OF THE PREFERRED EMBODIMENTS

Figures 6, 7:
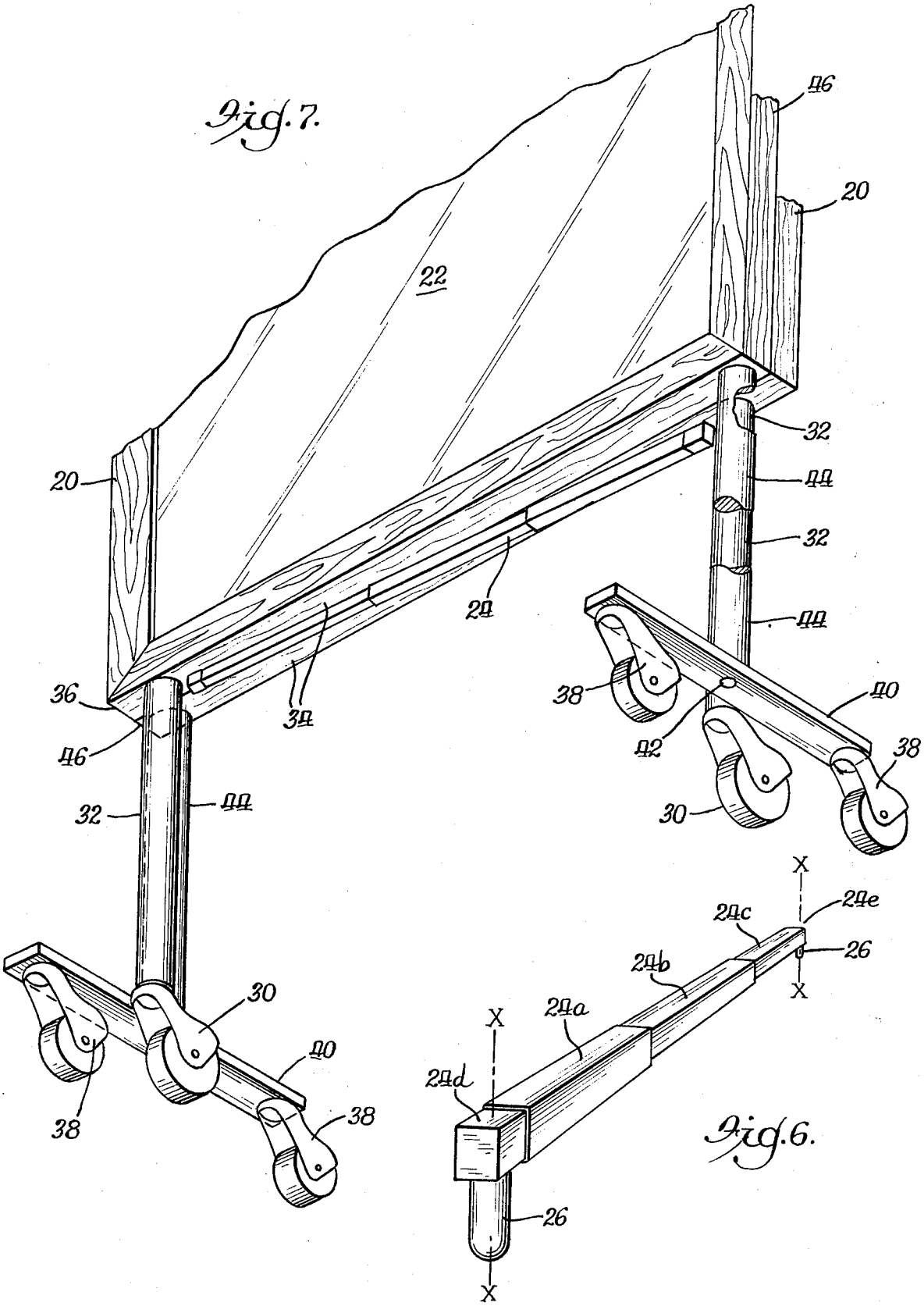
FIG. 6 is a perspective view of one of the telescopic rods illustrated in the previous figures.
FIG. 7 is a fragmentary, bottom, perspective view of FIG. 3 showing details of the supporting legs and wheel means in closed position.

Referring now to the free standing embodiment of the invention shown in FIGS. 1–7, it comprises a pair of upright rectangular frames 20, each having a reflecting mirror 22 suitably fastened to the front side. The mirror frames are interconnected by telescopic rods 24 one of which is shown enlarged in FIG. 6. These are illustrated as 3-section rods having three telescopically interfitting square cross section tubes **24*a*, 24*b* and 24*c* between end fittings 24*d* and 24*e*. A vertical pin 26 is rotatably journaled (by bearing means not shown) in each of the end fittings. As best shown in FIGS. 1 and 3, the pins 26 are seated in holes 28 which are located near, but slightly spaced from, the rear ends of the top and bottom edges of the frames 20. The pins 26 may be seated in the holes 28 in any suitable manner such as by a force-friction fit, or with an adhesive. The pins 26 in each frame are aligned along vertical axes X—X (FIG. 1) which are horizontally spaced in a vertical plane Y—Y (FIG. 2). The longitudinal axes of rods 26** also lie in the plane Y—Y. Although these rods are shown in three sections, they may have different numbers of sections as desired. Further, while square cross section tubing is illustrated, round cross section tubing may be substituted.

The free standing embodiment of FIGS. 1–7 is supported on wheel means which is here illustrated as caster wheels providing a stable, independent, 3-point support for each frame. As best shown in FIG. 7, a caster wheel 30 is mounted at the end of a leg 32 fastened to the bottom edge 34 of each frame, set back slightly from the extreme rear end 36 to provide room for another pair of caster wheels 38, 38 when in the closed position as will be explained. Each pair of caster wheels 38, 38 are mounted at the ends of a bar or bracket 40 attached as by a screw 42 to a leg 44 at the extreme forward end 46 of the bottom edge of each frame. The brackets 40 are transverse to the mirror frames so the pairs of caster wheels 38, 38 are located respectively fore and aft of the corresponding frames to which they are attached to provide independent, stable, 3-point support for them.

In the open position of the free-standing version shown in FIGS. 1 and 2, the two frames 20, 20 will be separated a maximum distance as permitted by the maximum extension of the rods 24. This maximum extension should be identical for both rods in order that the back edges 46 of the frames will be upright and parallel, and the axes X—X will be vertical, parallel and congruent with the vertical plane Y—Y. In addition, each frame 22 will be rotated about the pins 26 on axes X—X to similar angles, as shown in FIG. 2. At this open position, a person standing at a location A (FIG. 2) can view his side and back in the same manner as with the side or wing mirrors in conventional 3-mirror apparatus.

At position B (FIG. 2) which is here shown at the intersection of lines 48 and 50, at right angles to the mirrors, a person can view himself from the front, straight-on, in either mirror, in the manner that the center mirror is used in a conventional 3-mirror apparatus.

When the free-standing model shown in FIGS. 1–7 is not in use, it can be folded to a very compact, closed position shown in FIGS. 3–5 and 7, and can be rolled to an out-of-the-way location. In this closed position, the rods 24 will be retracted to a length less than the maximum shown in the open position. As best shown in FIGS. 3, 4 and 7, the caster wheel 30 at one extreme rear end of each frame nests compactly alongside the pair of caster wheels 38, 38 at the opposite end of the other frame. This is an advantage resulting from setting the caster wheels 30 slightly inwardly from the back end 36 as described above.

As best shown in FIGS. 1 and 5, latch means 52 is provided at the tops and bottoms of the frames to hold them together in closed position. Each comprises a ball member 54 extending from one of the frames into engagement with a spring socket member 56 in the other frame.

Figure 8:
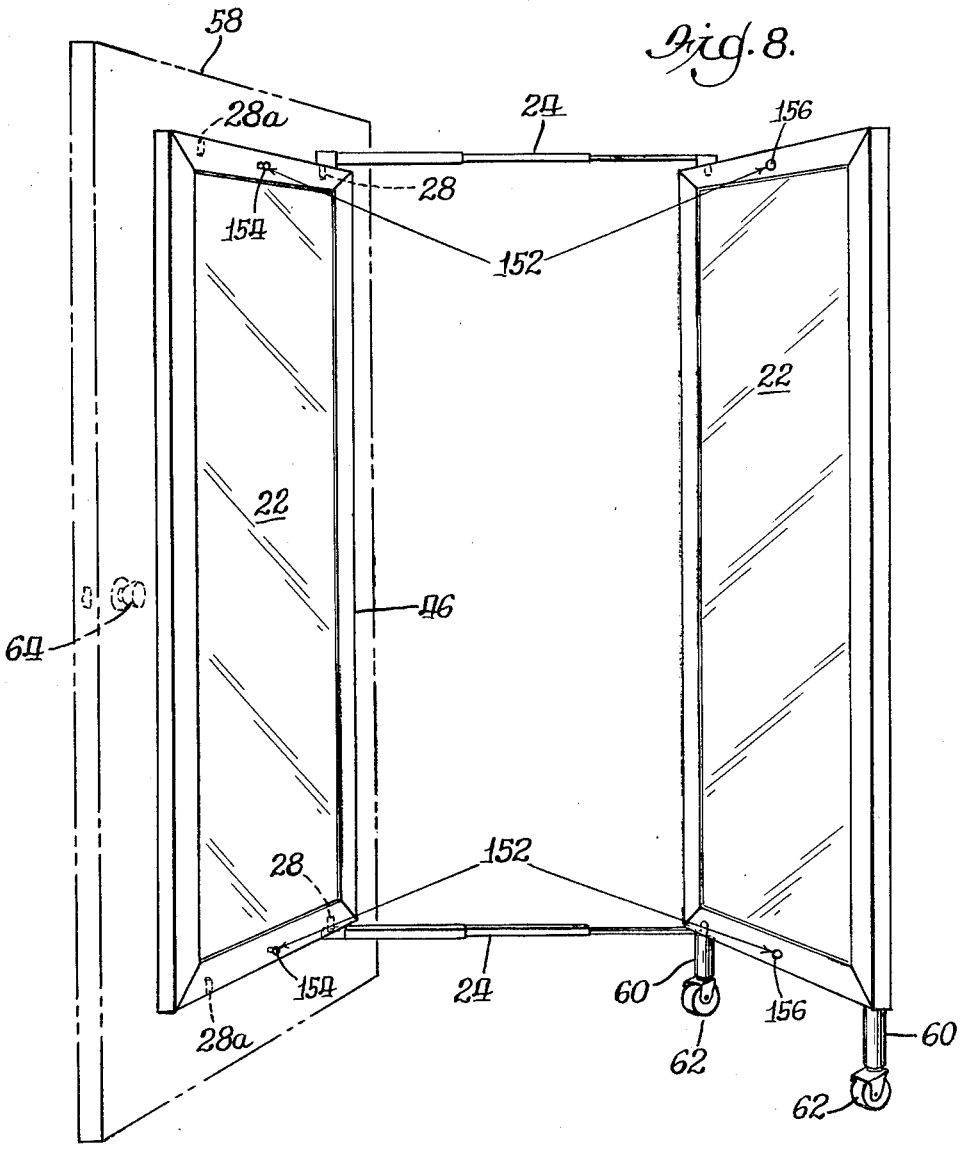
FIG. 8 is a view similar to FIG. 1, in the open position, showing a semi-free-standing version connected to a vertical member such as a door.
Figure 9:
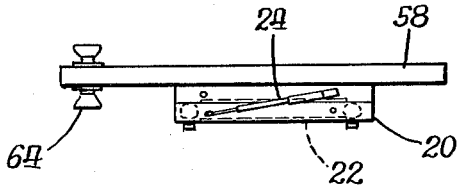
FIG. 9 is a top, plan view of the apparatus shown in FIG. 8.
Figure 10:
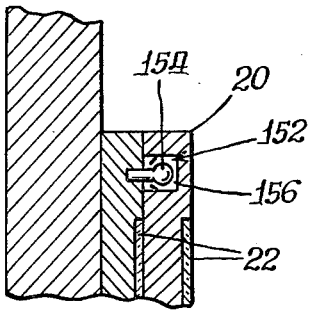
FIG. 10 is a fragmentary enlarged cross-sectional view of FIG. 9 taken along line 10—10.

An alternative semi-free-standing version shown in FIGS. 8–10 is substantially the same as the free-standing version described above, except for the following two differences: (1) one of the mirror frames 20 is supported on a vertical member such as a door 58; and (2) the other mirror frame is mounted on legs 60 with single caster wheels 62. The open position is shown in FIG. 8, this being similar to the open position of the free-standing version in FIG. 1. The closed position is shown in FIG. 9 where the two mirror frames are positioned back-to-front on the door and movable with it while the caster wheels 62 support its weight on the floor. As shown in FIG. 10, the mirror side 22 of the front frame 20 faces forwardly and is available for use as a front-on, direct mirror and moves back and forth with the door as it is opened and closed. In the closed position shown in FIG. 10, latch means 152 is provided at the tops and bottoms of the mirror frames to hold them together. Each comprises a ball member 154 extending from one of the frames into engagement with a spring socket 156 in the other frame. This is comparable to the ball 54 and spring socket 56 described above in connection with FIG. 5. Preferably, the back edge 46 of the mirror frame on the door is attached adjacent to the hinged side of the door (opposite the handle 64) to minimize movement of the mirror apparatus if the door is opened and closed when the mirror apparatus is in the open position shown in FIG. 8.

For a door which opens the opposite way from that shown in FIG. 8, that is where the hinges are on the left instead of the right, the pivot pins 26 for the rods will be seated in alternate holes **28*a* at the top and bottom edges of the mirror frame opposite holes 28**.

Referring to FIG. 11, rod **24*x* is similar to rod 24 previously described except that it has a pair of collars 23 and 25 pivotally journaled in grooves 32*a* formed on posts 32. Thus, the ends of rod 24*x* are pivotable about the centers of the posts 32**.

The above described versions are illustrative of a small number of many possible specific embodiments of the invention. Numerous and varied other arrangements can readily be devised in accordance with the principles disclosed by those skilled in this art without departing from the spirit and scope of the invention.

The embodiments of the invention in which an exclusive property or privilege is claimed are defined as follows:

1. Full view dual-use mirror apparatus comprising:

a pair of upright rectangular frames each having a reflecting surface on the front side thereof;

said frames being interconnected by telescopically extendible and retractible rod means enabling said apparatus to be unfolded to a spread, open position and folded to a compact, closed position;

said frames when in said open position being spaced horizontally apart with the planes of their reflecting surfaces diverging forwardly and outwardly at acute angles relative to a common rear vertical plane for use as dual mirrors;

said frames being pivotally connected to the ends of said rod means about spaced, parallel vertical axes parallel to said vertical plane;

said frames when in said closed position being positioned one in front of and contiguous to the other parallel to said rear vertical plane with the reflecting surface of the front frame facing forwardly for use as a single mirror; and means supporting said frames uprightly in both said open and closed positions.

2. Full view dual-use mirror apparatus according to claim 1 in which said rod means comprises a pair of vertically aligned telescopically extendible retractible rods at the top and bottom edges respectively of said frames.

3. Full view dual-use mirror apparatus according to claim 2 in which each said rod comprises a plurality of telescopically engaging tubes, and means for limiting the extension of said rods to keep said frames parallel at maximum extension of said rods.

4. Full view dual-use mirror apparatus according to claim 1 in which said apparatus is free standing and said means for supporting said frames uprightly comprises first wheel means at the bottom edge of each frame adjacent the corresponding vertical axis and dual wheel means fore and aft of each frame at the bottom edge thereof opposite said first wheel means.

5. Full view dual-use mirror apparatus according to claim 4 in which said first wheel means and said dual wheel means are caster wheel means and dual caster wheel means respectively.

6. Full view dual-use mirror apparatus according to claim 1 in which latch means act between adjacent front and back surfaces of the frames to hold them in said closed position.

7. Full view dual-use mirror apparatus according to claim 1 in which one of said frames is supported on a vertical member above a floor and the other of said frames is supported on caster wheel means engageable with said floor in both closed and open positions of said apparatus.

8. Full view dual-use mirror apparatus according to claim 7 in which said vertical member is a door attached to a wall by hinge means and the rear edge of said one frame is adjacent the hinge side of the door to minimize movement of said mirror apparatus when the door is swung about said hinge means.

9. Full view dual-use mirror apparatus according to claim 4 in which said wheel means and said dual wheel means are mounted at the bottom ends of vertical legs which support said frames a predetermined distance above the floor, and each end of said telescopically extendible and retractible rod at the bottoms of said frames is pivotally connected to one of said posts on each of said frames.

10. Full view dual-use mirror apparatus according to claim 9 in which said rod has a ring at each end pivotally journaled in a groove on a corresponding one of said legs.

* * * * *